United States Patent [19]

Guttmann

[11] Patent Number: 4,982,737

[45] Date of Patent: Jan. 8, 1991

[54] ORTHOTIC SUPPORT CONSTRUCTION

[76] Inventor: Jaime C. Guttmann, Tiradentes No. 10 Centro Comercial Dalyn, Ens. Naco Santo Domingo, Dominican Republic

[21] Appl. No.: 363,155

[22] Filed: Jun. 8, 1989

[51] Int. Cl.[5] ..... A43B 7/14; A43B 7/18

[52] U.S. Cl. ..... 128/581; 128/586; 128/595; 128/613; 36/71.5; 36/31; 36/59 R; 36/59 C; 36/15; 36/110; D2/274; D2/370; D2/318

[58] Field of Search ..... 36/71.5, 71, 44, 43, 36/31, 59 R, 59 C, 15, 110; 128/582, 583, 586, 596, 602, 603, 584, 595, 613, 581; D2/274, 320, 318

[56] References Cited

U.S. PATENT DOCUMENTS

| | | | |
|---|---|---|---|
| 1,409,704 | 3/1922 | Gizzi | 36/71.5 |
| 1,768,648 | 7/1930 | Welch | 128/615 |
| 3,742,627 | 7/1973 | Schneider | 36/71 X |
| 4,841,648 | 6/1989 | Shaffer et al. | 128/615 X |

*Primary Examiner*—V. Millin
*Assistant Examiner*—P. Kubel
*Attorney, Agent, or Firm*—Darby & Darby

[57] ABSTRACT

The present invention provides an orthotic support construction that is attachable to the undersurface of the front portion of the sole of the shoe for treating a disorder of the foot by supporting a selected region of the foot when the shoe is worn. The support construction comprises an elongated planar sheet, preferably of rectangular form, adapted to be mounted on the shoe sole with one of its major surfaces against the undersurface of the shoe sole. The sheet is preferably formed from a flexible, resilient, shearable, and essentially inelastic material that is trimmed to the outline of the front portion of the shoe sole and cemented in place. The sheet has an elevated portion of increased thickness projecting from the other of its major surfaces so as to underlie and thereby, to support the selected region by exerting pressure through the shoe sole against the selected region.

9 Claims, 2 Drawing Sheets

FIG. 1
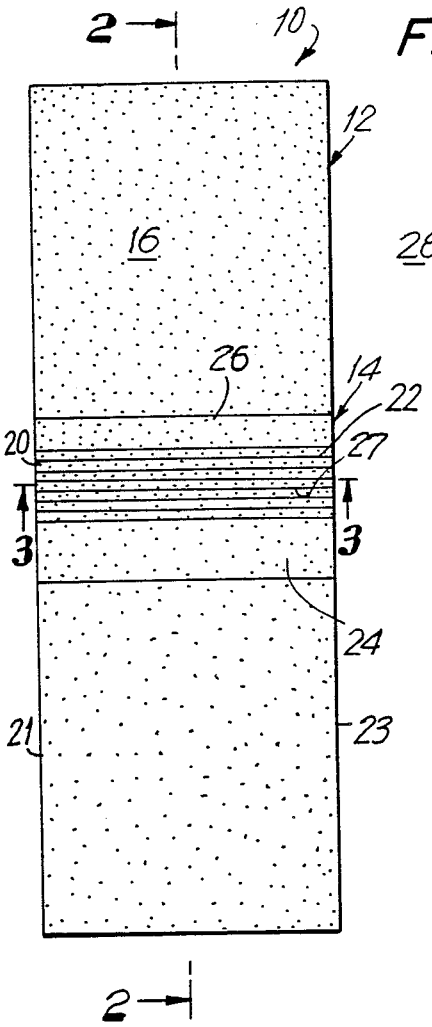
FIG. 2
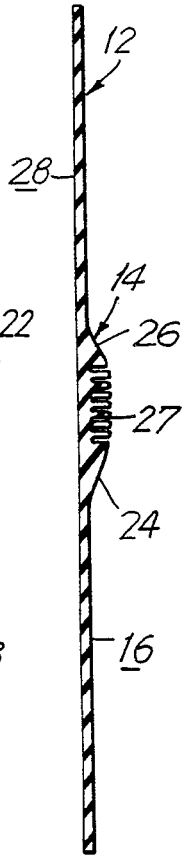
FIG. 4
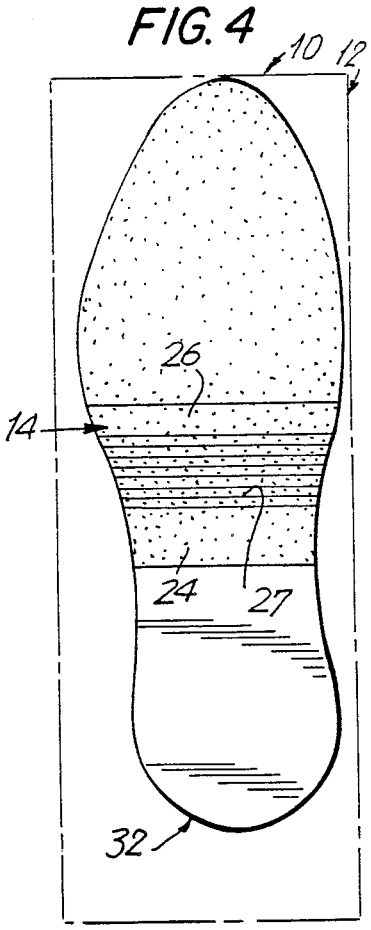
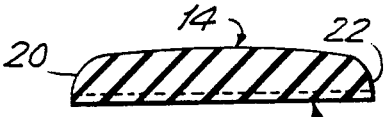
FIG. 3
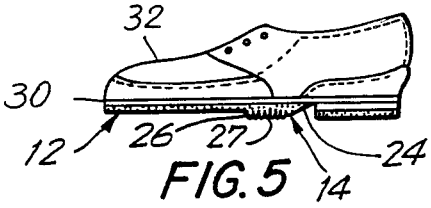
FIG. 5

ORTHOTIC SUPPORT CONSTRUCTION

FIELD OF THE INVENTION

The present invention relates to an orthotic support construction formed by a sheet of material attached to the undersurface of a shoe sole. The sheet has an elevated portion configured to support a selected region of the foot by exerting pressure through the shoe sole against the selected region.

BACKGROUND OF THE INVENTION

The prior art has provided orthotic support constructions that are worn within the shoe in order to alleviate foot pain and to treat injuries, diseases, and congenital malformations of the foot. Such orthotic support constructions are generally formed by one or more podiatric appliances that are attached to a base plate. The base plate and the attached podiatric appliances generally serve as an insole with the podiatric appliances of such orthotic support constructions supporting selected regions of the foot by directly exerting pressure on the selected regions when the wearer applies weight against the podiatric appliances.

An example of an orthotic support construction, as described above, is disclosed in U.S. Pat. No. 4,603,698, of which I am the inventor. In this patent a number of different podiatric appliances are provided that are independently attachable to an inner sole-like base plate fabricated of a stiffly flexible material. The appliances disclosed in the patent include, among others, an arch support to provide additional support to the arch of the foot, a metatarsal tear to rest the metatarsal bones, and a bunion support appliance. The assembled orthotic support construction may either be worn as an insole or may form a sandal-like orthopedic shoe.

Any of the prior art orthotic support constructions, including those disclosed in U.S. Pat. No. 4,603,698, when worn within the shoe over a long period of time, produce increased wear on the sole of the shoe and deform the shoe. Additionally, a malformed or injured foot may in itself deform the shoe to an extent that the orthotic support construction will not fit within the shoe in the first instance.

SUMMARY OF THE INVENTION

The present invention provides an orthotic support construction that is attachable to the front portion of the sole of a shoe for supporting a selected region of the foot when the shoe is worn.

The support construction comprises an elongated, planar sheet adapted to be attached along one of its major surfaces to the undersurface of the shoe sole. The sheet has an elevated portion of increased thickness projecting from the other of its major surfaces so as to underlie and, thereby, to support the selected region of the foot by exerting pressure through the shoe sole and against the selected region.

Since the support construction of the present invention is attached to the undersurface of the shoe sole, the support construction itself exhibits wear rather than the shoe sole. In this regard, preferably, the orthotic support construction of the present invention is attached to the shoe by a cement that, when heated, permits the worn orthotic support construction to be removed and replaced by a new support construction. Moreover, preferably, the orthotic support construction is formed of an inelastic material to reinforce the shoe and, thereby, to prevent deformation of the shoe.

BRIEF DESCRIPTION OF THE DRAWINGS

In the accompanying drawings:

FIG. 1 is a bottom plan view of an embodiment of an orthotic support construction in accordance with the present invention that is used to relieve pressure on the metatarsal portion of the foot;

FIG. 2 is a sectional view taken along line 2—2 of FIG. 1;

FIG. 3 is a sectional view taken along line 3—3 of FIG. 1;

FIG. 4 is a bottom plan view of the orthotic support construction illustrated in FIG. 1 attached to the undersurface of the front portion of a shoe sole;

FIG. 5 is an elevational view of FIG. 4;

Figures 6, 7, 8, 9, 10:
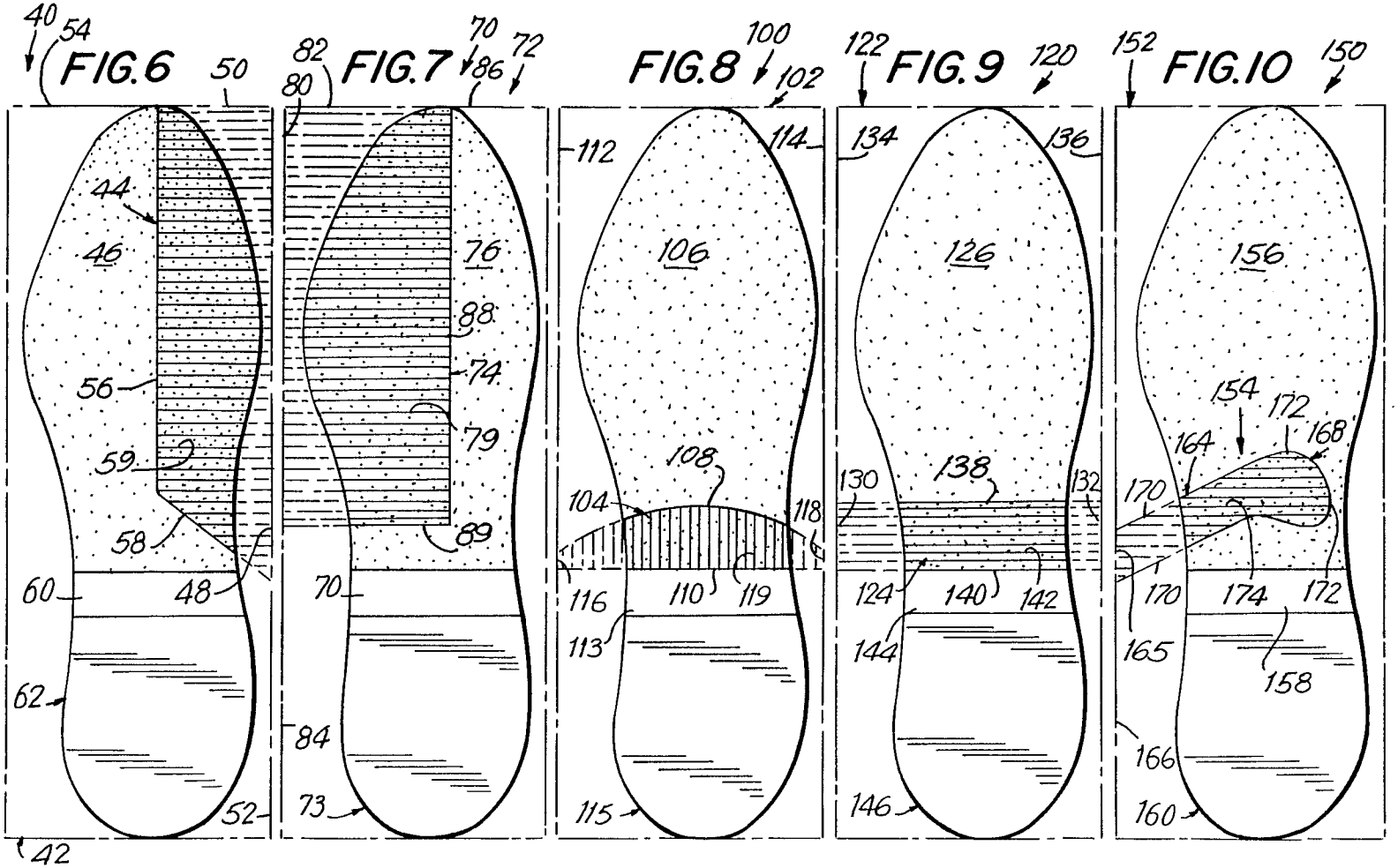
FIG. 6 is a bottom plan view of another embodiment of an orthotic support construction in accordance with the present invention that is used to correct step position.
FIG. 7 is a bottom plan view of another embodiment of an orthotic support construction in accordance with the present invention that is used to correct foot balance.
FIG. 8 is a bottom plan view of another embodiment of an orthotic support construction in accordance with the present invention that is used with high heel shoes to relieve pressure the metatarsal portion of the foot.
FIG. 9 is a bottom plan view of another embodiment of an orthotic support construction in accordance with the present invention that is used with flat shoes to relieve pressure in the metatarsal region of the foot.
FIG. 10 is a bottom plan view of another embodiment of an orthotic support construction in accordance with the present invention that is used to orient the foot away from calluses and to alleviate pressure in the metatarsal and arch portions of the foot.

The embodiments of the orthotic support constructions of the present invention shown in FIG. 4 and FIGS. 7–10, are illustrated as mounted on the undersurface of the front portion of the sole of the shoe after having been trimmed to the outline of the shoe sole. The cutaway portions of the orthotic support constructions are illustrated by phantom lines. This allows the construction of the present invention to be made, especially, in a single size and formed to the needed size without undue effort.

DETAILED DESCRIPTION OF THE INVENTION

With reference to FIGS. 1 through 5, a preferred embodiment of an orthotic support construction 10 in accordance with the present invention is illustrated. Orthotic support construction 10 is formed by a rectangular sheet 12 of, preferably, a flexible, resilient, shearable and essentially inelastic material, such as PVC or a mixture of PVC and rubber. Sheet 12 is provided with an elevated portion 14 of increased thickness projecting from one of the major surfaces 16 of sheet 12 and sized to underlie and support a selected region of the foot extending from the arch portion of the foot to a location adjacent to the metatarsal portion of the foot in order to relieve pressure in the metatarsal portion of the foot. As illustrated, elevated portion 14 comprises a rectangular projection of sheet 12 that merges, preferably arcuately, along ends 20 and 22, into the lengthwise edges 21 and 23 of sheet 12 and feathers into major surface 16, along sides 24 and 26.

Sheet 12 is mounted on a sole 30 of a shoe 32 by first positioning sheet 12 with its opposite major surface 28 against the undersurface of sole 30, such that elevated portion 14 underlies the aforementioned region of the foot when shoe 32 is worn. Thereafter, sheet 12 is cut to the outline of the front portion of sole 30 and is, then, preferably cemented in place by use of cements as known in the art.

When shoe 32 is worn, elevated portion 14 exerts pressure upon the foot from the arch of the foot to an area adjacent to the metatarsal portion of the foot through sole 30, in reaction to the weight of the wearer bearing against elevated portion 14. As a result, pressure is relieved in the metatarsal portion of the foot to alleviate foot pain. Curved ends 20, 22 (when not cut off during trimming of sheet 12) and feathered sides 24, 26 of elevated portion 14 prevent the wearer from tripping over elevated portion 14 during walking. The preferred inelastic quality of the material forming sheet 12 reinforces shoe 32 in order to prevent deformation of the shoe produced by long term use or orthotic construction 10. The preferred resiliency of the material cushions the foot; and its flexibility allows sheet 12 to flex with the flexure of the shoe produced during walking. In this regard, elevated portion 14 is preferably provided with transverse grooves 27 to further promote flexure of elevated portion 14.

Eventually, sheet 12 will become worn and will require replacement. At such time, sheet 12 may be heated to melt the cement attaching sheet 12 to shoe 32, and a replacement sheet 12 can subsequently be formed, in the same manner as the original sheet, and attached to shoe 32.

The other embodiments of the present invention, discussed below, are all preferably formed from sheet material having the same qualities of resiliency, flexibility, etc. as sheet 12, discussed above. Moreover all of such other embodiments are trimmed to the outline of the shoe sole, attached to the shoe sole and subsequently removed when worn, in the same manner that sheet 12 is attached and removed from sole 30 of shoe 32.

FIG. 6 illustrates an orthotic support construction 40, in accordance with the present invention, that is designed to correct step position problems in which the feet are angled toward one another, each being inwardly rotated about a longitudinal, medial line of the foot so that the wearer naturally tends to walk on the inner portion of the feet with a staggering gait. Support construction 40 is formed by a rectangular sheet 42 having an elevated portion 44 of increased thickness projecting from a major surface 46 of sheet 42. Elevated portion 44 comprises a trapezoidal projection of sheet 42 that is sized to support a selected region of the foot extending from the arch to the toes and bounded by an inner edge of the foot and the medial longitudinal line of the foot.

Preferably, elevated portion 44 merges, arcuately, along its longer side 48 and along its shorter end 50, into one of the lengthwise edges 52 of sheet 42 and one of the transverse edges 54 of sheet 42 in the same manner as ends 20 and 22 of projection 14 of sheet 12. Additionally, elevated portion 44 is preferably feathered, along its shorter side 56 and its longer end 58, into major surface 46 of sheet 42 in the same manner as sides 24 and 26 of elevated portion 14 of sheet 12. As with elevated portion 14 of sheet 12, elevated portion 44 is preferably provided with a plurality of parallel, transverse grooves 59 to enhance the flexibility of elevated portion 44.

When sheet 42 is trimmed to size and attached to the front portion of a sole 60 of a shoe 62, elevated portion 44 levels the foot so that the wearer now tends to walk with the foot outwardly oriented to a normal orientation. As may be appreciated, although not illustrated, a mirror image of sheet 42 would be provided for the opposite foot.

FIG. 7 illustrates an orthotic support construction 70 that is designed to correct a foot balance problem in which the foot is outwardly rotated about the medial longitudinal line of the foot and is outwardly angled from the normal orientation of a foot. Support construction 70 is formed by a rectangular sheet 72 provided with an elevated portion 74 of increased thickness projecting from one of its major surfaces 76. In order to correct such a foot balance problem, elevated portion 74 comprises a rectangular projection sheet 72 that is sized to underlie and support a region of the foot extending from the arch to the toes and bounded by the outer edge of the foot and the longitudinal medial line of the foot.

Elevated portion 74, merges, preferably arcuately, at one of its lengthwise sides 80 and one of its transverse sides 82, into one of the lengthwise edges 84 of sheet 72 and one of the transverse edges 86 of sheet 72, respectively, in the manner of ends 20 and 22 of elevated portion 14 of sheet 12. Additionally, preferably the other lengthwise and transverse sides 88 and 89 of elevated portion 74 feather into major surface 76 of sheet 72 in the same manner as sides 24 and 26 of tread surface 18 of sheet 12. Elevated portion 74 is preferably provided with transverse grooves 79 to promote flexure of elevated portion 74.

When sheet 72 is trimmed to size and mounted on a sole 70 of a shoe 73, elevated portion 74 levels the foot so that the foot inwardly rotates about its medial, longitudinal line and inwardly angles into a normal orientation of the foot. As may be appreciated, although not illustrated, a mirror image of sheet 72 would be provided for the other shoe.

FIGS. 8 and 9 illustrate orthotic support constructions 100 and 120 that in a manner similar to support construction 10, discussed above, relieve pressure in the metatarsal portion of the foot. The elevated portions of these orthotic support construction are, however, sized to centrally underlie and support only the arch of the foot. As a result, the pressure applied by either of such support constructions is greater and more concentrated than that provided by support construction 10.

With specific reference to FIG. 8, orthotic support construction 100 is formed by a rectangular sheet 102 having an elevated portion 104 of increased thickness projecting from a major surface 106 of sheet 102. Elevated portion 104 comprises a projection of sheet 102 that is formed by an arcuate leading section 108 and a straight trailing section 110 connecting the lengthwise edges 112 and 114 of sheet 102. A pair of opposed lengthwise sections 116 and 118 of elevated portion 104 connect leading and trailing sections 108 and 110 and preferably merge arcuately into lengthwise edges 112 and 114 in the same manner as ends 20 and 22 of elevated portion 14 of sheet 12. Additionally, the leading and trailing sections 108 and 110 preferably feather into major surface 106 of sheet 102 in the same manner as sides 24 and 26 of elevated portion 14 of sheet 12. A plurality of parallel, lengthwise grooves 119 may be provided in elevated portion 104.

With specific reference to FIG. 9, orthotic support construction 120 is formed by a sheet 122 having an elevated portion 124 projecting from a major surface 126 of sheet 122. Elevated portion 124 comprises a rectangular projection of sheet 122. The ends 130 and 132 of elevated portion 124 preferably merge into the lengthwise edges 134 and 136 of sheet 122 in the same manner as ends 20 and 22 of elevated portion 14 of sheet 12. Additionally, the sides 138 and 140 of elevated portion 124 preferably feather into major surface 126 of sheet 122 in the same manner as sides 24 and 26 of elevated portion 14 of sheet 12. Elevated portion 124 may be provided with a plurality of parallel, transverse grooves 142 that, like grooves 27 of elevated portion 14, may extend through the feathered sides of elevated portion 124.

When sheet 102 is trimmed to size and mounted o the front portion of shoe sole 113 of a shoe 115, grooves 119 inhibit flexure of elevated portion 104 during walking to provide firm support beneath the arch of the foot. Such firm support is required with a high heel shoe. When sheet 122 is mounted onto shoe sole 144 of a shoe 146, transverse grooves 142 promote flexure of elevated portion 124 with sole 144 during walking. As a result, less pressure is provided by elevated portion 124 than elevated portion 104.

With reference to FIG. 10, an orthotic support construction 150 is illustrated that is used to level the foot away from calluses and to alleviate pain in the arch and metatarsal portions of the foot. Support construction 150 is formed by a sheet 152 having an elevated portion 154 projecting from a major surface 156 of sheet 152. In order to treat such a foot disorder, elevated portion 154 is configured to underlie, and extend at an angle, across the arch of the foot to a location adjacent to the metatarsal portion when sheet 152 is attached to the undersurface of sole 158 of a shoe 160. Elevated portion 154 includes a shank section 164, angled, at one end 165, from one of the lengthwise edges 166 of sheet 152, and an enlarged head section 168, contiguous with shank section 164, to underlie the foot adjacent to its metatarsal portion.

Sides 170 of shank section 164 and the periphery 172 of head section 168 feather into major surface 156 in the same manner as sides 24 and 26 of elevated portion 14 of sheet 12. End 165 of shank section 164 merges into lengthwise edge 166 of sheet 152 in the same manner as ends 20 and 22 of elevated portion 24 of sheet 12. Additionally, elevated portion 154 is provided with a plurality of transverse grooves 174 to permit elevated portion 154 to flex with sole 158 during walking.

As indicated for any of the embodiments of applicant's invention, discussed above, the orthotic support constructions are fabricated from a rectangular sheet that is designed to be trimmed to the outline of the front portion of a shoe sole. Shoe soles, however, increase in size with increasing size of footwear. Thus, any of the orthotic support constructions discussed above are preferably provided in four sheet sizes, for example, 8.50×21.0 cm., 24.0×9.0 cm., 28.0×10.0 cm., and 33.0×13.0 cm. As may be appreciated, the sheets can be pre-cut to the outlines of shoe soles. This would not be preferred because shoe soles of the same size, but different styles, often have slightly different outlines.

While specific embodiments of the invention have been shown, the invention should not be considered as so limited, but only as limited as set forth in the appended claims.

I claim:

1. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region, said sheet being fabricated from a flexible, resilient, shearable, and essentially inelastic material and having a rectangular configuration of greater size than the front portion of the shoe sole, wherein said sheet has lengthwise edges, said elevated portion comprises a rectangular projection arcuately merging, along its ends, into the lengthwise edges of the sheet, and feathered, along its sides, into the other major surface of the sheet, sized to underlie and support the selected region of the foot defined by an area of the foot extending from the arch of the foot to a location adjacent to the metatarseal portion of the foot, and having a plurality of parallel, transverse grooves to allow flexure of said elevated portion with flexure of the shoe sole during walking.

2. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region, said sheet being fabricated from a flexible, resilient, shearable, and essentially inelastic material and having a rectangular configuration of greater size than the front portion of the shoe sole, wherein said sheet has lengthwise and transverse edges, said elevated portion comprises a trapezoidal projection arcuately merging, along the shorter of its ends and along the longer of its sides, into one of the transverse edges of the sheet and one of the lengthwise edges of the sheet; feathered, along the shorter of its sides and along the longer of its ends, into the other major surface of the sheet; and sized to underlie and support the selected region of the foot extending from the arch to the toes and bounded by the inner edge of the foot and a medial, longitudinal line of the foot, and having a plurality of parallel transverse grooves to allow said elevated portion to flex with the flexure of the shoe sole during walking.

3. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region, said sheet being fabricated from a flexible, resilient, shearable, and essentially inelastic material and having a rectangular configuration of greater size than the front portion of the shoe sole, wherein said sheet has lengthwise and transverse edges, said elevated portion comprises a rectangular projection arcuately merging, along one of its sides and along one of its ends, into one of the lengthwise edges of said sheet and one of the transverse edges of said sheet; feathered, along the other of its sides and along the other of its ends, into the major surface of said sheet; and sized to underlie and support the selected region of the foot defined by an area extending from the arch to the toes and bounded by the outer edge of the foot and a medial, longitudinal line of the foot, and having a plurality of parallel transverse grooves to allow said elevated portion to flex with flexure of the shoe sole during walking.

4. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region, said sheet being fabricated from a flexible, resilient, shearable, and essentially inelastic material and having a rectangular configuration of greater size than the front portion of the shoe sole, wherein said sheet has lengthwise edges, said elevated portion comprises a projection defined by a pair of opposed, spaced, arcuate and straight leading and trailing sections connecting the opposite lengthwise edges of the sheet, and a pair of opposed lengthwise sections connecting the ends of said leading and trailing sections, said leading and trailing sections feathering into the other major surface of the sheet, the projection sized to centrally underlie and support the arch portion of the foot, and having a plurality of lengthwise grooves to inhibit flexure of said elevated portion produced by flexure of said shoe sole during walking in order to provide firm support to the arch portion of the foot.

5. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region.

said sheet being fabricated from a flexible, resilient, shearable, and essentially inelastic material and having a rectangular configuration of greater size than the front portion of the shoe sole, wherein said sheet has lengthwise edges, said elevated portion comprises a rectangular projection arcuately merging, along it ends, into a lengthwise edge of the sheet, feathered, along its sides, into the other major surface of the sheet, sized to centrally underlie and support the arch portion of the foot, and having a plurality of parallel transverse grooves to allow said elevated portion to flex with flexure of the shoe sole during walking.

6. An orthotic support construction attachable to the sole of a shoe for supporting a selected region of the foot when the shoe is worn, said support construction comprising:

an elongated planar sheet adapted to be attached along one of its major surfaces to the undersurface of the shoe sole, the sheet having an elevated portion of increased thickness projecting from the other of its major surfaces, said elevated portion being located and configured to underlie and support the selected region by exerting pressure through the shoe sole against the selected region, said sheet being fabricated from a flexible, resilient, shearable, and essentially inelastic material and having a rectangular configuration of greater size than the front portion of the shoe sole, wherein said sheet has lengthwise edges, said elevated portion is configured to underlie and extend across the selected region defined by an area of the foot extending across the arch of the foot and a location of the foot adjacent to the metatarsal portion of the foot, the elevated portion including a projection of said sheet having a shank section angled, at one end, from one of the lengthwise edges of the sheet to underlie the arch of the foot, an enlarged head section contiguous with the other end of said shank section to underlie the location of the foot adjacent to its metatarsal portion, and a plurality of transverse grooves to allow said elevated portion to flex with flexure of the shoe sole during walking.

7. An orthotic support construction attachable to the sole of a shoe for supporting a selected region of the foot when the shoe is worn, said support construction comprising:

an elongated sheet having one major planar surface adapted to be attached to the under surface of the shoe sole, the opposite surface of said sheet having a projecting elevated portion of increased thickness and a planar portion with a surface generally parallel to said one major planar surface, said elevated portion being located at and configured to underlie and support the selected region of the foot by exerting pressure through the shoe sole against the selected region.

8. The orthotic support construction of claim 7 wherein said sheet is fabricated from a flexible, resilient, shearable, and essentially inelastic material and has a rectangular configuration of greater size than the front portion of the shoe sole.

9. An orthotic support construction as in claim 7, wherein said sheet covers the entire sole of a shoe when attachment is made thereto.

* * * * *